US008827580B2

(12) United States Patent
Nowak et al.

(10) Patent No.: US 8,827,580 B2
(45) Date of Patent: Sep. 9, 2014

(54) MEDIA FEEDING SYSTEM FOR CUTTING DIMENSIONAL DOCUMENTS AND METHODS OF MAKING AND USING SAME

(75) Inventors: William J. Nowak, Webster, NY (US); Robert A. Clark, Williamson, NY (US); Kathleen A. Feinberg, Rochester, NY (US); Peter J. Knausdorf, Henrietta, NY (US); Thomas C. Hollar, Penfield, NY (US); Thomas J. Wyble, Williamson, NY (US); Linn C. Hoover, Webster, NY (US); William J. Hannaway, Webster, NY (US); Jess R. Gentner, Rochester, NY (US); Frank M. Goetz, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 131 days.

(21) Appl. No.: 13/439,369

(22) Filed: Apr. 4, 2012

(65) Prior Publication Data

US 2013/0266358 A1 Oct. 10, 2013

(51) Int. Cl.
*B41J 11/00* (2006.01)

(52) U.S. Cl.
USPC ..... 400/621; 400/617

(58) Field of Classification Search
USPC ..... 400/621
See application file for complete search history.

(56) References Cited

U.S. PATENT DOCUMENTS

| | | | | |
|---|---|---|---|---|
| 3,866,901 | A | 2/1975 | Brock | |
| 4,368,881 | A | 1/1983 | Landa | |
| 5,275,077 | A | 1/1994 | Kobayashi | |
| 5,321,892 | A | 6/1994 | Sasada | |
| 5,379,998 | A * | 1/1995 | Nakagawa | 271/248 |
| 5,435,538 | A | 7/1995 | Billings et al. | |
| 5,443,194 | A | 8/1995 | Takahashi | |
| 5,932,704 | A * | 8/1999 | Jubinsky | 530/388.22 |
| 6,039,479 | A * | 3/2000 | Hill et al. | 400/621 |
| 6,109,745 | A * | 8/2000 | Wen | 347/101 |
| 6,427,744 | B2 * | 8/2002 | Seki et al. | 156/353 |
| 6,664,995 | B2 | 12/2003 | Milton et al. | |
| 6,863,273 | B2 * | 3/2005 | Otto | 271/270 |
| 7,559,549 | B2 | 7/2009 | Clark et al. | |
| 7,588,245 | B2 | 9/2009 | Mandel et al. | |
| 7,731,188 | B2 | 6/2010 | deJong et al. | |
| 7,746,524 | B2 | 6/2010 | Lofthus et al. | |
| 7,789,484 | B2 | 9/2010 | Takada et al. | |
| 7,934,718 | B2 | 5/2011 | Clark | |
| 8,056,897 | B2 | 11/2011 | deJong et al. | |
| 8,316,749 | B2 * | 11/2012 | Rimai et al. | 83/865 |
| 8,657,512 | B2 * | 2/2014 | Crystal et al. | 400/621 |
| 2010/0058943 | A1 | 3/2010 | Bober | |
| 2011/0152048 | A1 | 6/2011 | Gombert et al. | |
| 2011/0283849 | A1 | 11/2011 | Takizawa | |

* cited by examiner

*Primary Examiner* — Anthony Nguyen
(74) *Attorney, Agent, or Firm* — Alix, Yale & Ristas, LLP

(57) ABSTRACT

A media feeding and cutting system is disclosed herein which comprises a media cutter including a cutting surface and a digital cutting device, a first feeder configured to automatically transport individual sheets of media from an in-feed receptacle toward the cutter, a positioner configured to position the medium on the cutting surface, a second feeder disposed adjacent to or connected to the cutting surface which is configured to automatically transport the cut medium from the cutter to an out-feed receptacle, and a processor configured to operate the cutter, first feeder, positioner and second feeder. Additional related systems and methods also are disclosed.

24 Claims, 11 Drawing Sheets

MEDIA FEEDING SYSTEM FOR CUTTING DIMENSIONAL DOCUMENTS AND METHODS OF MAKING AND USING SAME

BACKGROUND

The embodiments disclosed herein generally relate to a system and method for producing documents. More particularly, the disclosure relates to a system and method for the production of dimensional documents.

Conventional systems for producing dimensional documents, such as megaphones, small boxes, photo-geo-domes, and the like, are generally complex and expensive. For example, they may include a printing system, a coating system and a die-cutting system all connected to automatically perform these operations in sequence. In one known method of producing dimensional documents having custom printing, the text and/or images are printed on stock, a two-dimensional document is then cut from the stock using a flat or rotary die system, and the two-dimensional document is folded and glued to form a three-dimensional document. In some cases, the printing is performed on a thin stock that is later glued to a heavier weight stock to provide greater stability and strength. In other cases, the printing is performed on heavyweight stock.

In another known method, the printing and/or images are printed on pre-cut stock to form a two-dimensional document, and the two-dimensional document is then folded and glued to form a three-dimensional document. In this method, the printing is generally performed on a heavier weight stock, requiring printing apparatus that can handle such stock. In addition, the pre-cut stock is generally more expensive, must be inventoried, and this method limits the flexibility of the printer in terms of the sizes and designs that can be produced.

Conventional systems that are less complex and/or less expensive than those described above only process one sheet of material at a time. Known systems suitable for small print shops require a dedicated operator to hand place a single printed sheet into the digital cutter, execute the cutting job from an attached computer, remove the job from the cutter when the cut is complete and then load the next printed sheet in place for subsequent cutting. To satisfy the needs of small print shops, a low-cost system with automatic feed-on and feed-off operations to minimize labor overhead is required.

SUMMARY

One embodiment described herein is a media feeding and cutting system comprising a media cutter including a cutting surface and a digital cutting device, a first feeder, a positioner configured to position a sheet of media on the cutting surface, a second feeder and a processor. The first feeder is disposed adjacent to or is connected to the cutting surface, and is configured to automatically transport individual sheets of media from an in-feed receptacle toward the cutter using a first feed device. The positioner includes a first sensor that senses a first edge of a sheet of media. The second feeder is disposed adjacent to or is connected to the cutting surface, and automatically transports the cut sheet of media from the cutter to an out-feed receptacle. The processor operates the cutter, first feeder, positioner and second feeder.

Another embodiment described herein is a media feeding system comprising a media in-feed receptacle, a first feeder, a media out-feed receptacle, a second feeder, and a processor. The first feeder is configured to be retrofitted to a first side of a digital cutter, and includes a first feed device configured to automatically transport individual sheets of media in a forward feed direction from the media in-feed receptacle to the digital cutter. The second feeder is configured to automatically transport individual sheets of media from the cutter to the media out-feed receptacle. The processor is configured to operate the first feeder and the second feeder.

Yet another embodiment is a method of making an automatic digital cutter, comprising obtaining a media in-feed receptacle, a media out-feed receptacle, a first feeder, and a digital cutter. The first feeder includes a first feed device configured to automatically transport individual sheets of media in a forward feed direction. The digital cutter is configured for single sheet manual feed, and includes a cutter feed device configured to move a sheet of media in a forward and backward direction, and a controller. The method comprises retrofitting the digital cutter with the media in-feed receptacle, first feeder, and media out-feed receptacle, and programming the controller to utilize the cutter feed device to automatically position media fed to the cutter using the first feeder prior to cutting.

A further embodiment is a method of feeding media to and from a cutting surface of a digital cutter, comprising acquiring a sheet of media from an in-feed receptacle using an automatic first feeder that includes a first feed device, automatically moving the sheet of media in a forward feed direction between first and second baffles to the cutting surface using the first feeder, and automatically placing the sheet of media on the cutting surface. The sheet of media is then moved in a backward feed direction using a second feed device in order to position the sheet of media on the cutting surface at a desired location, cut, automatically fed out of the cutter using a second feeder, and released into an out-feed receptacle.

DETAILED DESCRIPTION

Figure 1:
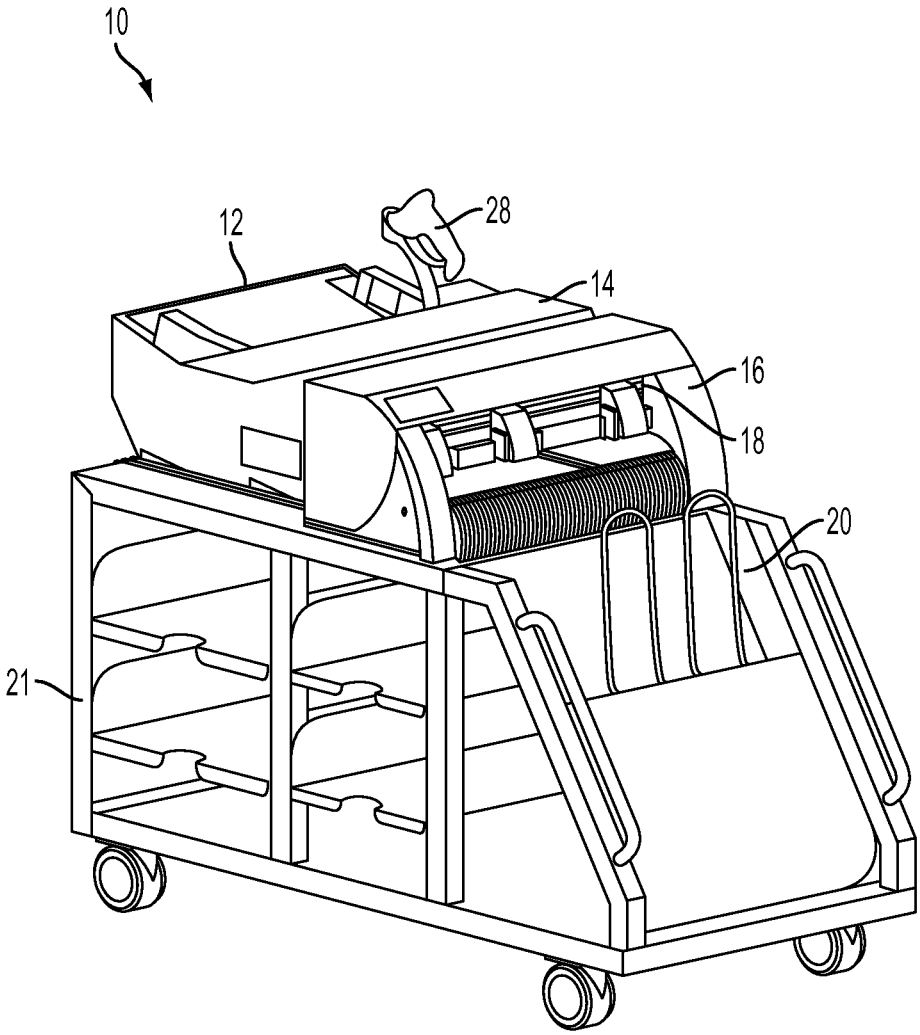
FIG. 1 is a perspective view of a media cutting and feeding system according to one embodiment.

As used herein, "dimensional document" refers to a three-dimensional object formed by cutting and folding a flat sheet of media. In most cases, the dimensional document has printed matter, such as text and images disposed on the surface thereof (or in some cases has a uniform pigmented or dyed color). "Media" refer to any sheet-shaped stock, such as paper, cardboard, paper board, vinyl, etc. that may be formed into a dimensional document. "Cut" means to cut and/or score. A "digital cutter" is a device used to digitally cut and/or digitally score media. A "feeder" as used herein refers to an apparatus that feeds media. "Feed device" as used herein refers to a feed roll or rolls, or a vacuum feed device. "Retard feed technology" refers to various techniques for accurately separating and feeding sheets using a feed roll and a retard roll or pad, "Vacuum feed technology" refers to various techniques for moving a sheet through a feed path using a vacuum. "Cutting surface" refers to the platform or other horizontal, angled or vertical, flat or non-flat surface in the cutter where the media is positioned during cutting.

One embodiment described herein is a device that automates the process of feeding sheets of media to a cutter used in forming dimensional documents. The system adds an automatic feed-on function, and optionally includes an automatic feed-off function, for a cutting system capable of performing digital cutting operations on sheet media. In embodiments, automation is accomplished by adding an in-feeder incorporating retard feed technology that employs one or more rolls and/or a retard pad, and/or incorporating vacuum feed technology, including hardware along with software and/or firmware, in order to automatically feed paper onto the cutting surface. Further automation occurs by incorporating hardware along with software and/or firmware to eject a cut sheet from the cutter, and integrating a stacking out-feed receptacle to receive the cut media after the cutter job is complete.

In one embodiment, an automated media in-feeder, a manual-feed cutter which is modified to receive automatically fed media from the in-feeder, and an output stacking receptacle are integrated in series to form a comprehensive, automated system. The system is economically produced and occupies a sufficiently small amount of space that it can be fit within a small print shop, rendering it a valuable alternative to complex and expensive automatic feeding and cutting systems. The embodiments described herein allow small print shops to get into the business of creating dimensional documents on heavy weight media, making the automatic production of packing and other dimensional documents a service that can be used by small business customers.

In embodiments, the in-feed media handling system employs retard feed technology. The details of certain embodiments of retard feed technology are described in U.S. Pat. No. 4,368,881, the contents of which are incorporated by reference herein in their entirety. The use of retard feed technology is particularly advantageous to allow heavy weight cover stock to be automatically fed as single sheets to the cutter without resulting in mis-feeding of media. In contrast, conventional low priced digital cutters require an operator to manually feed each sheet. In embodiments, the retard feed technology incorporates a retard roll. In embodiments, a retard pad can be used, often as part of a buckle feeder. Retard feed technology can be used with or without use of a fluffer.

In embodiments, vacuum feed technology can be used to feed media in and out of the cutter. A vacuum feed employing suction cups and/or a vacuum belt can be used, with or without use of a fluffier. In embodiments, buckle feeders can be used to feed media in and out of the cutter.

FIG. 1 schematically illustrates an automatic feed cutting system for producing dimensional documents. The cutting system, which is designated generally as 10, includes an in-feed receptacle 12, an automatic in-feeder 14, a cutter 16, an automatic out-feeder 18, which, in the embodiment of FIG. 1, is disposed inside the cutter, and an output receptacle 20. The in-feed receptacle 12 is configured to hold a media stack that includes a plurality of sheets. The feeder usually is configured to transport sheets individually to the cutter. In the embodiment shown in FIG. 1, the cutting system is mounted on a cart 21, but a table or other mounting surface also can be used. The embodiment shown in FIG. 1 includes a sensor 28 that reads data on the media to determine what type of digital cut file is to be used. In embodiments, the data is an information code, such as a 1D or 2D bar code, a 2D QR code, or the like. In some embodiments, the cutting instructions are resident on the cutter and the sensor senses data indicative of the instructions to be used. In embodiments, the sensor is an optical reader, such as an optical scanner.

Figure 2:
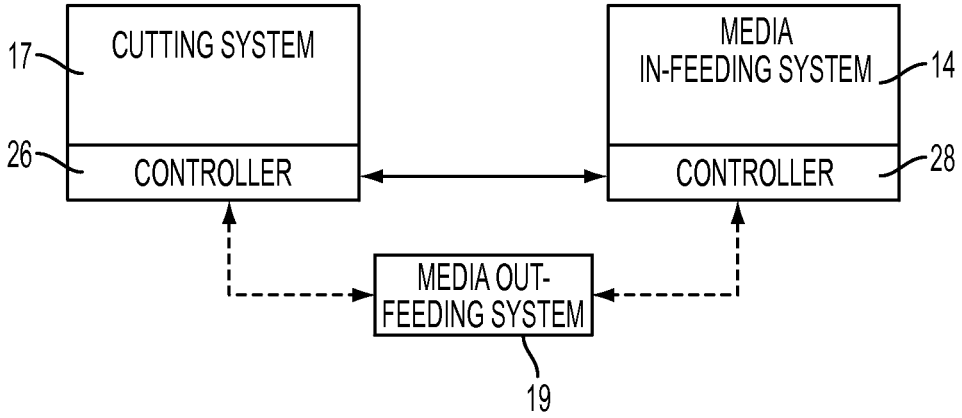
FIG. 2 is a simplified schematic view of a media and cutting and feeding system according to another embodiment.
Figure 3:
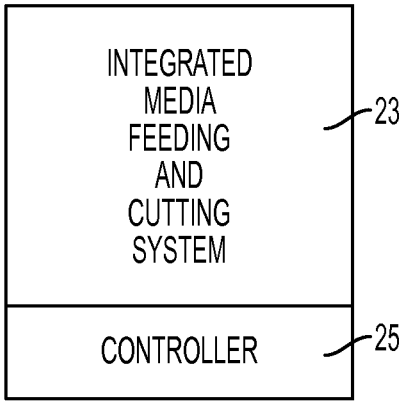
FIG. 3 is a simplified schematic view of a media cutting and feeding system according to another embodiment.
Figure 4A:
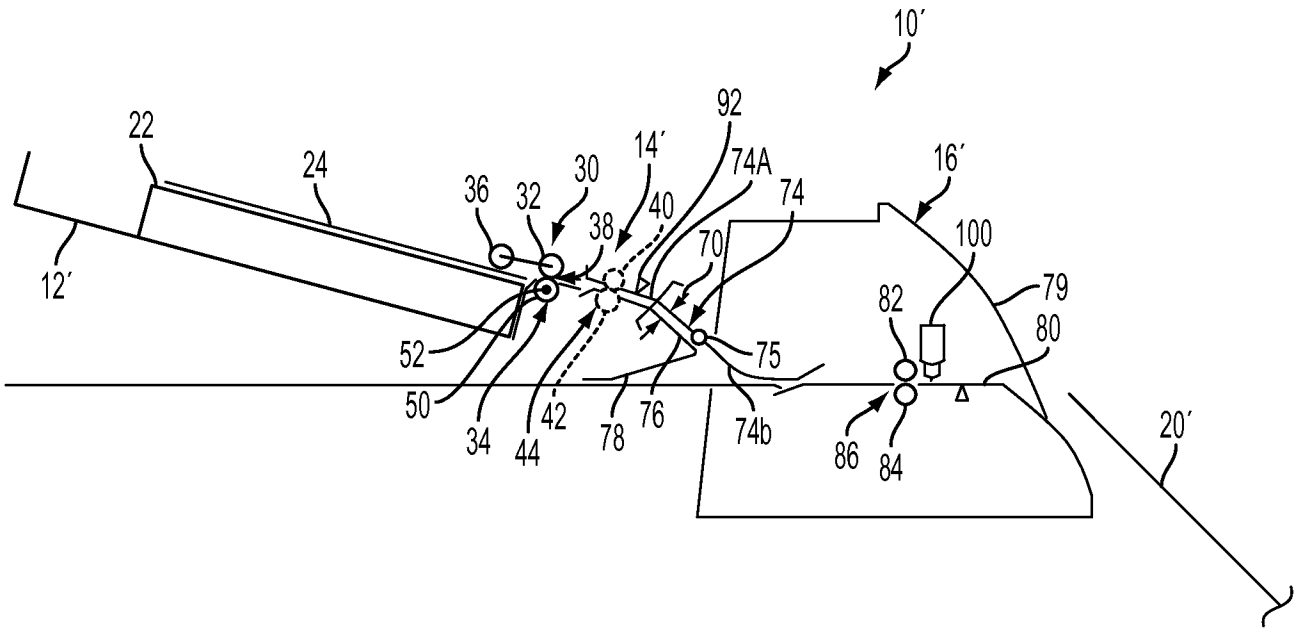
FIGS. 4A-4D are simplified schematic views showing operation of a first embodiment of a media cutting and feeding system that includes automatic in-feed to the cutter and automatic out-feed from the cutter
Figure 4B:
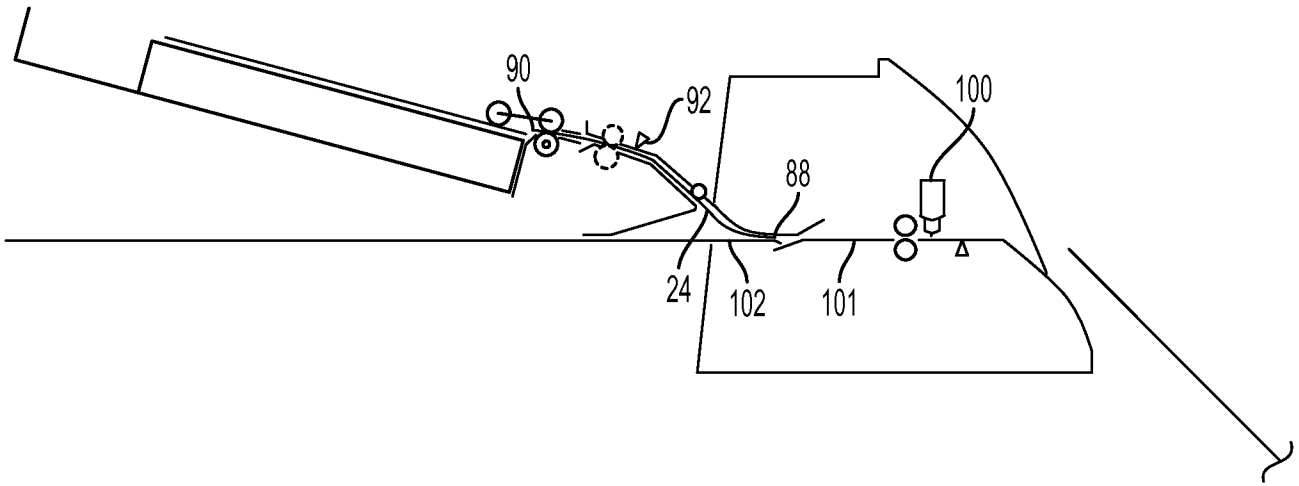
Figure 4C:
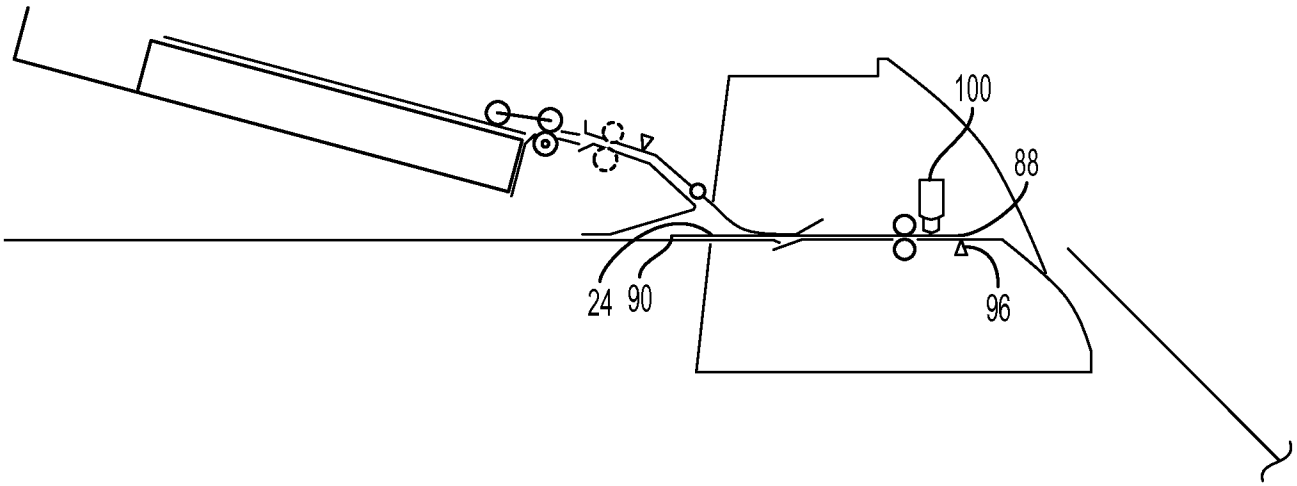
Figure 4D:
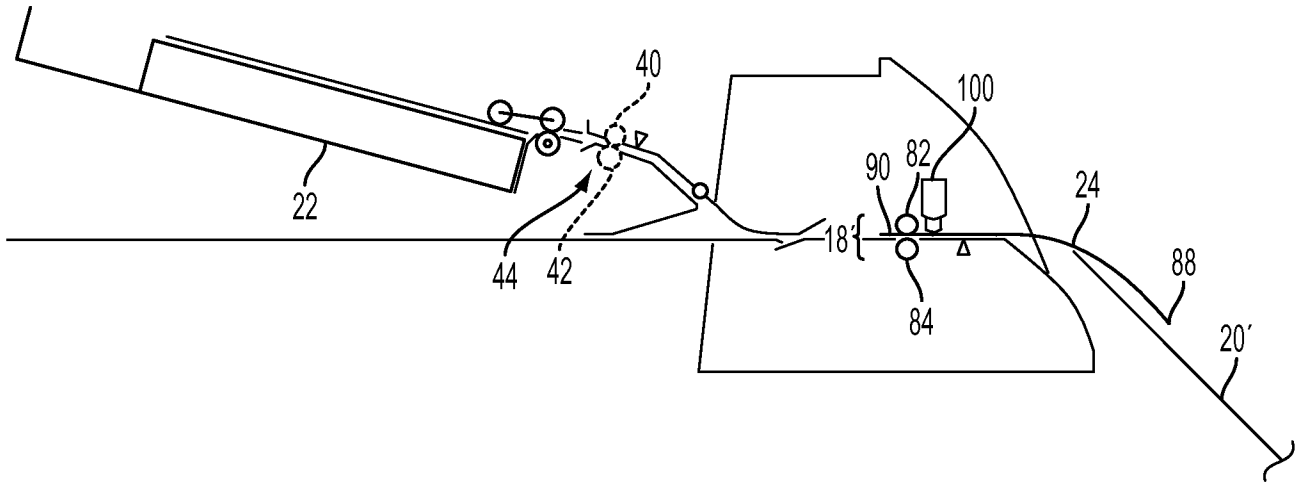

FIGS. 2-3 show relationships between the cutter and the media feeding system in various embodiments. In the embodiment of FIG. 2, the cutter includes a cutting system 17, which includes a cutting knife, and a controller 26. The automatic in-feeder includes a media in-feeding system 14 and a controller 28. The media out-feeding system 19, which is part of the automatic out-feeder, can be controlled by the media in-feed controller, the cutter controller, or a separate controller (not shown). The embodiment of FIG. 2 can be used when an existing cutter is retrofit to integrate automatic in-feed and out-feed systems. In the embodiment of FIG. 3, an integrated media feeding and cutting system 23 has a single controller 25. This embodiment can be used, for example, by adapting an existing cutter to incorporate additional apparatus and software, or by constructing an integrated feeding and cutting system.

As is shown in FIGS. 4A-4D, one embodiment described herein is an automatic feed cutting system, designated as 10'. The automatic in-feeder 14' includes a retard feed assembly 30, a nudger roll 36 upstream from the retard feed assembly 30, and an optional downstream pair of take-away rolls 40, 42 that form a nip 44 for feeding sheets 24 of media into the cutter 16'. The sheets of media often, but not necessarily, are pre-printed. The retard feed assembly 30 includes a drive roll 32 and a retard roll 34 that together form a nip 38 for forwarding the sheets to the take-away rolls 40, 42 and/or into the cutter 16'. During operation the nudger roll 36 contacts the uppermost sheet 24 of stack 22 from in-feed receptacle 12', and rotates to advance the uppermost sheet 24 from stack 22 into the retard feed assembly 30.

The retard roll 34 includes a cylindrical section 50 that is supported for rotation on a shaft 52. The retard roll 34 optionally has an integral slip clutch (not shown) to separate double fed sheets. The details of the slip clutch technology are described in U.S. Pat. No. 5,435,538, the contents of which are incorporated by reference herein in their entirety.

The pair of take-away rolls 40, 42 is disposed downstream of the retard feed assembly 30 and moves a sheet 24 of media along a media feed path 70, defined above and below the sheet by an upper baffle 74 and an intermediate baffle 76, and into the cutter 16'. The sheet 24 of media moves in a forward feed direction in the embodiment shown in FIGS. 4A-4C. In the embodiment shown in FIGS. 4A-4D, the upper baffle 74 is sheet-shaped with a cross-section having a sideways-tilted, slight S-shaped curve, with the upwardly concave portion of the S being at the upstream end. The intermediate baffle 76 conforms to the shape of the upstream portion of the upper baffle 74 in order to form a media path of substantially uniform width. In the embodiment shown in FIGS. 4A-4D, the intermediate baffle 76 is connected to a lower baffle 78, the function of which is explained below. In this embodiment, the intermediate baffle 76 and lower baffle 78 are formed from a sheet with a generally sideways V-shaped cross section. In embodiments, the upper baffle 74 is formed in two parts, namely an upper first baffle 74*a* and an upper second baffle 74*b*, with upper first baffle 74*a* directing the media into the cutter and upper second baffle 74*b* directing the sheet of media onto the cutting surface. The upper second baffle 74*b* can be pivotally rotated relative to a shaft 75 to facilitate access to a sheet 24 of media entering the cutter 16' if, for example, a media jam occurs.

The cutter 16' includes a housing 79, a cutting surface 80 and a pair of cutter rolls 82, 84, defining a nip 86 configured to move the sheet 24 through the cutter 16'. After the leading edge 88 of the sheet 24 passes into the cutter 16', the sheet 24 is moved though the cutter 16' by the take-away rolls 40, 42 (or the retard feed assembly, if no take-away rolls are used) until the leading edge portion of the sheet is picked up by the nip 86. After the leading portion of the sheet 24 is disposed between the cutter rolls 84, 86, the trailing edge 90 of the sheet passes out of the take-away rolls 40, 42 and beyond the lower baffle 76 of the media feed path 70. At this point, the trailing edge 90 of the sheet 24 falls downward onto the cutting surface 80. The sheet 24 continues to be moved along inside the cutter 16' using the cutter rolls 82, 84.

A first edge sensor 92 is positioned to detect the leading edge 88 and/or the trailing edge 90 of the sheet 24. In embodiments, after the trailing edge 90 passes beyond the sensor 92, the sheet continues to move away from the feeder until a predetermined period of time has passed and the trailing edge 90 is on the cutting surface 80. Once the entire sheet 24 is on the cutting surface 80, the direction of movement of the sheet 24 optionally can be reversed, and the trailing edge 90 of the sheet 24 is guided backwards under the media path 70, below the lower baffle 78. In some cases the trailing edge 90 of the sheet 24 passes out from the feeder 16' on an extension platform 102, which effectively extends the cutting surface upstream toward the in-feed receptacle 12'. The sheet 24 continues to travel in the reverse direction until the leading edge 88 of the sheet is detected by a second edge sensor 96. When the second edge sensor 96 determines that the sheet is correctly positioned to begin the registration process for cutting, movement of the sheet 24 stops by halting rotation of the cutter rolls 82, 84. The sheet is then registered for cutting and the sheet is digitally cut with a digital cutting knife or pen 100. A conventional digital cutting system, including a document registration system, can be used. Depending on the type of cutter that is employed, the sheet and/or the digital cutting blade move during the cutting process.

In a variation of the system shown in FIGS. 4A-4D, instead of using one or both of sensors 92, 96, an open loop system, or partially open loop system, can be used to properly position the sheet of media in the cutter 16', using sheet size data and calculations of sheet velocity as the sheet 24 of media moves into and/or within the cutter 16'. In other variations, additional or alternative sensors can be used to sense sheet position in the cutter 16'.

After cutting is completed, the cut sheet is ejected to the output receptacle 20' using the cutter rolls 82, 84. In order to effect ejection of a sheet 24, a conventional cutter can be adapted by programming the cutter rolls to perform this function. In this case, the automatic out-feeder 18' includes the cutter rolls 82, 84. In another embodiment, an additional set of rolls (not shown) is added to eject the cut sheet of media.

In the embodiment shown in FIGS. 4A-4D, the cutting surface 80 is a platform and includes a first cutting platform 101 and an extension platform 102 that extends rearwardly on the upstream side of the cutting surface, and optionally outside of the upstream side of the cutter 16' itself, in a horizontal direction to accommodate the sheet as it enters the at the upstream side (in-feed receptacle side) of the cutter 16'. In contrast, conventional, manually fed cutters are usually fed from the downstream side of the cutter. The extension leaf 102 enables the trailing edge portion of the sheet 24 of media to be co-planar with the front edge portion before the rear edge portion of the sheet 24 enters the cutter 16'. This configuration, in combination with the configuration of upper baffle 74 and intermediate baffle 76, minimizes jam errors downstream of the retard feed assembly 30.

In some cases, the cutter 16', or a component disposed downstream from the cutter 16', imparts folds or creases in the media to facilitate folding of the document into a dimensional shape. Some cutters include a ceasing stage after cutting. A non-limiting example of a known creasing system is described in U.S. Patent Publication No. 2011/0152048, the contents of which are incorporated by reference herein in their entirety.

Figure 5A:
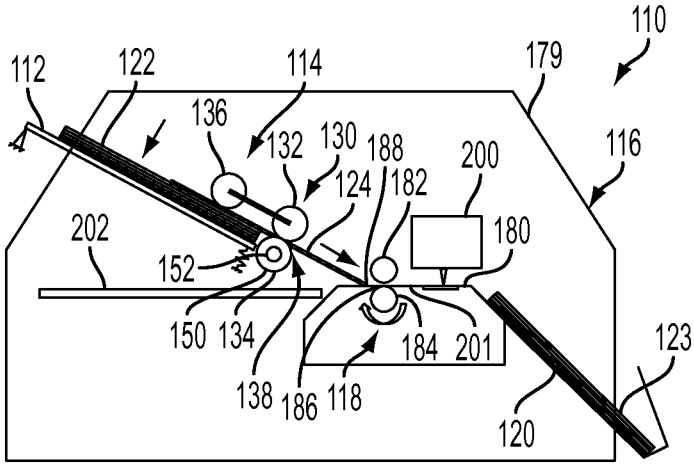
FIGS. 5A-5C are simplified schematic views showing operation of a second embodiment of a media cutting and feeding system that includes automatic in-feed to the cutter and automatic out-feed from the cutter.
Figure 5B:
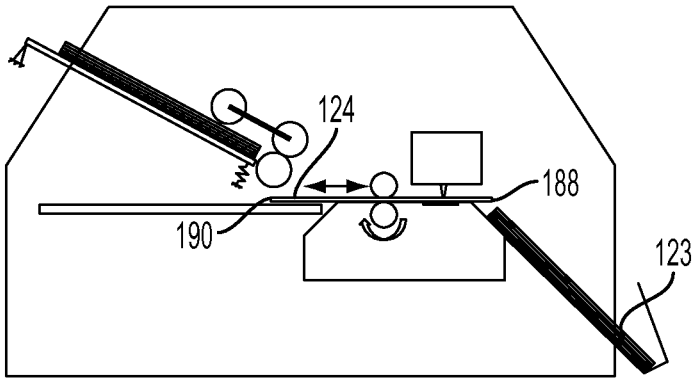
Figure 5C:
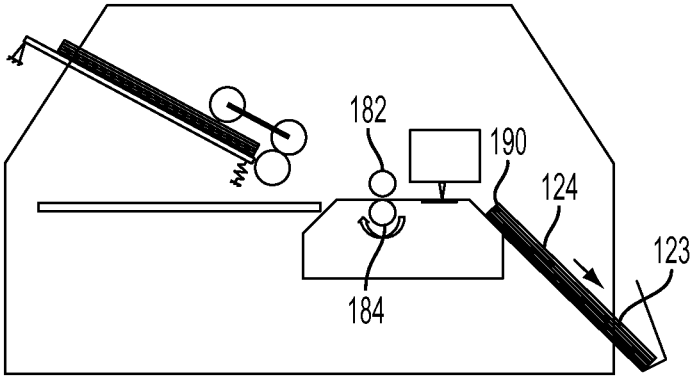

FIGS. 5A-5C schematically illustrate an embodiment in which take-away rolls are not used. In this configuration, the cutting system, which is designated generally as 110, includes an in-feed receptacle 112, an automatic in-feeder 114, a cutter 116, an automatic out-feeder 118, and an output receptacle 120. Portions of the in-feed receptacle 112 and output receptacle 120 are disposed in the housing 179 of the cutter 116. The in-feed receptacle 112 and the output receptacle 120 are each configured to hold a media stack, shown as an uncut stack 122 and a cut stack 123 of media sheets 124.

The automatic in-feeder 114 includes a retard feed assembly 130, and a nudger roll 136 upstream from the retard feed assembly 130. The retard feed assembly 130 includes a drive roll 132 and a retard roll 134 that together form a nip 138 for forwarding the sheets into the cutter 116. During operation the nudger roll 136 contacts the uppermost sheet 124 of stack 122 from in-feed receptacle 112, and rotates to advance the uppermost sheet 124 from stack 122 into the retard feed assembly 130.

The retard roll 134 includes a cylindrical section 150 that is supported for rotation on a shaft 152. The retard roll facilitates separation of double fed sheets. As indicated above, the details of the slip clutch technology are described in U.S. Pat. No. 5,435,538.

The drive roll 132 and retard roll 134 rotate to move a sheet 124 of media forward through the cutter 116. The cutter 116 includes a cutting surface 180 and a pair of cutter rolls 182, 184, defining a nip 186 configured to move the sheet 124 through the cutter 116. The sheet 124 is moved though the cutter 116 by the drive roll 132 and retard roll 134 until the leading edge portion of the sheet is picked up by the cutter nip 186. After the leading edge portion of the sheet 124 is disposed between the cutter rolls 182, 184, the trailing edge 190 of the sheet passes out of the retard feed assembly 130. At this point, the trailing edge 190 of the sheet 124 falls downward onto the extension platform 202 that extends upsteam from the cutting surface 180. The sheet 124 continues to be moved along inside the cutter 116 using the cutter rolls 182, 184. Once disposed horizontally on the cutting plate 180, the sheet 124 is registered, cut with a digital cutting knife 200 and ejected in a manner that may be the same as is described above in connection with FIGS. 4A-4D. The upper baffle, intermediate baffle and lower baffle (not shown in FIGS. 5A-5C) are optional and each can have generally the same configuration as in the embodiment of FIGS. 4A-4D. Sensors similar to those used in the embodiment of FIGS. 4A-4D can be used, and/or other suitable sensor arrangements can be employed.

As mentioned above, in the embodiment shown in FIGS. 5A-5C, the retard feed assembly 130 is disposed in the cutter 116 vertically above the upstream section of the cutting surface 180. In this embodiment, an extension platform 202 extends horizontally in an upstream direction from the upstream side of the first cutting platform 201 inside the cutter 116. The trailing edge portion of the sheet 124 is not co-planar with the front edge portion until the rear edge portion of the sheet 124 is well inside the cutter 116.

Similar to the embodiment of FIG. 1, the embodiments of FIGS. 4 and 5 also can include data sensors such as identification code scanners. This added step of automation further speeds the processing of several different print jobs in sequence that employ media from the same in-feed receptacle.

Figure 6:
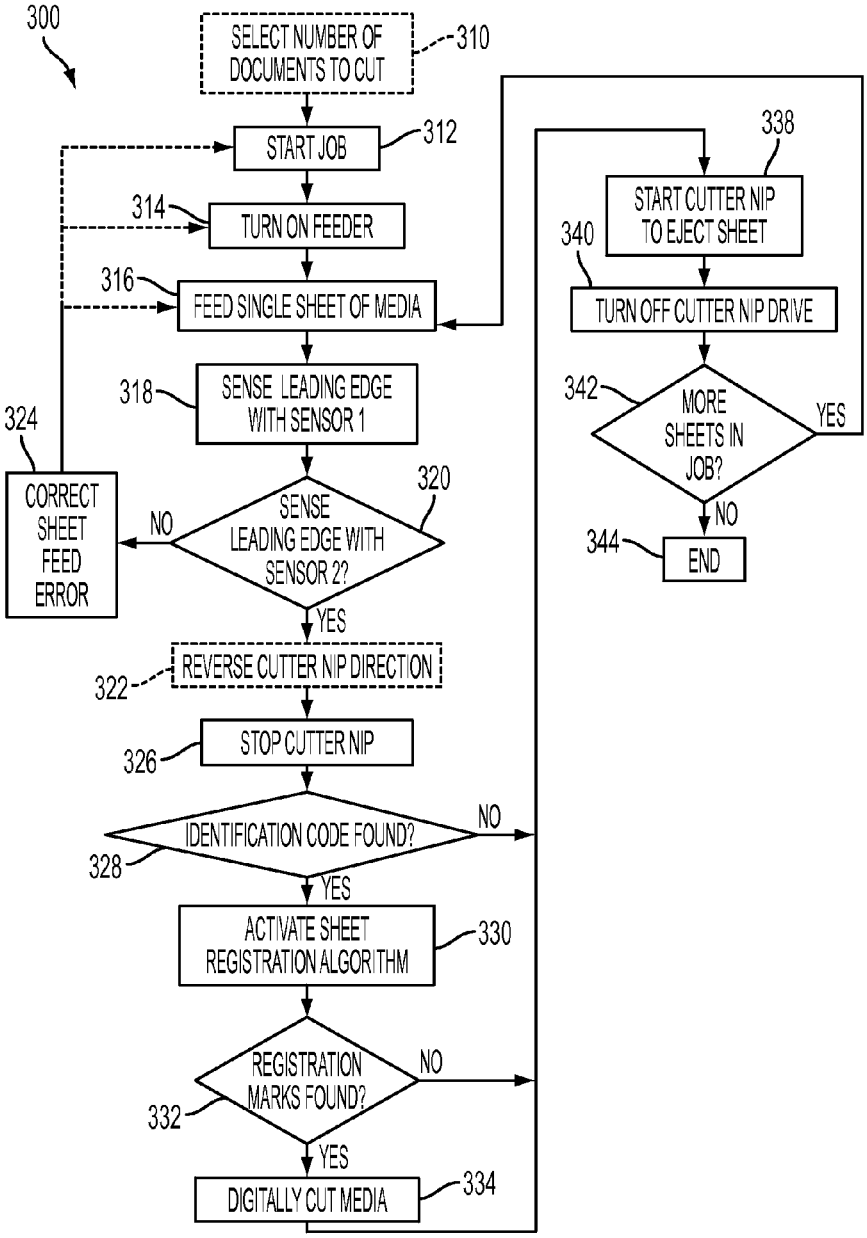
FIG. 6 is a flow diagram describing operation of the media cutting and feeding systems of FIGS. 4A-4D and 5A-5C in a mode in which a digital cutting program is automatically selected.
Figure 7:
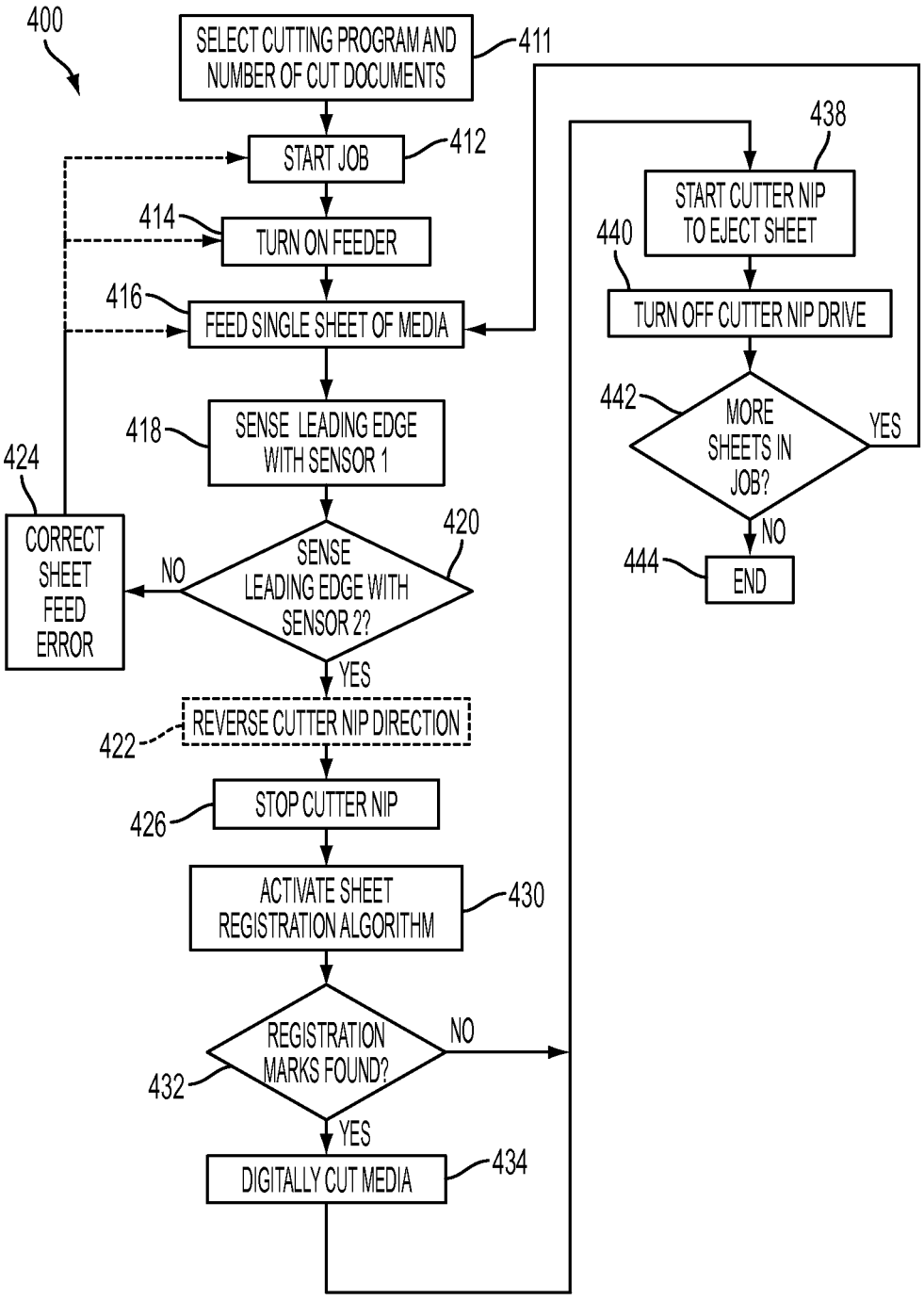
FIG. 7 is a flow diagram describing operation of the media cutting and feeding systems of FIGS. 4A-4D and 5A-5C in which an operator manually selected a digital cutting program.

The flowcharts shown in FIGS. 6 and 7 describe operation of the automated media feeding and cutting system. Automatic mode is shown in FIG. 6 and partially automatic, partially manual mode is described in FIG. 7. Briefly stated, in the automatic method described in FIG. 6, each individual media sheet (or the first sheet in a batch of sheets) has an identification code printed thereon that specifies which program file is to be used for digital cutting. After the system is turned on, the identification code scanner 28 reads the identification code, such as a barcode, on the media sheet on the top of the stack and sends a signal to the digital cutter as to which file should be used for cutting. The appropriate file is selected and the file is utilized to operate the cutting knife. When the system is operated in partially manual mode, no identification code scanner is used. An operator identifies the cutting program to be used and loads the cutting file located on a host PC (see FIGS. 8-9). This file of cutting instructions is then sent to the cutter, which cuts the sheet in accordance with the instructions contained in the cut file.

More particularly, as is shown in FIG. 6, the automated process is generally designated at 300. An operator optionally selects the number of documents to be cut at 310. (In some embodiments, instead of selecting the number of documents to be cut, the feed and cutter operate until no more identification codes are available to be read on media being fed, or until no more media is present in the in-feed receptacle.) The job is started at 312 by pressing a "start button" or in another manner. The feeder is turned on at 314, resulting in the automatic feeding of a first sheet of media at 316. The feeder often includes a nudger roll and a retard feed assembly. The take-away rolls (if included) are either turned on with the retard feed system or are activated when the presence of media is sensed. The media is automatically fed, one sheet at a time, using the feeder. While a sheet is moving towards the cutter, the sensor 28 (which may be an optical scanner, for example) reads the data on the sheet and sends the corresponding information to the controller. The sheet of media moves forward in the system until its leading edge is sensed with a first sensor at 318. The sheet of media continues to advance until it has passed into the cutter nip and its leading edge is sensed with a second sensor inside the cutter at 320. After sensing by the second sensor, the travel direction of the sheets often is reversed at 322. If the second sensor does not sense the sheet, a feed error is assumed to have occurred and the sheet feed error is corrected at 324. The process re-starts with a return to 312, 314 or 316.

If the travel direction of the sheet has been reversed at 322, the sheet travels in the reverse direction until it is properly aligned, according to sheet edge detection via the second sensor. At this point, the cutter nip stops at 326. If an identification code was found to be present, shown at 328, the (previously read) identification code information from the media is used by the controller to determine the proper cutting program to use. (If no identification code was found, the uncut sheet is ejected at 338 into the output receptacle by rotation of the cutter nip in a forward direction.) The controller sends a signal to the cutter as to which cutting program is to be used to cut the media, and the appropriate sheet registration algorithm is activated at 330. After the registration marks are found at 332, the media is digitally cut at 334. (If there is a problem finding the registration marks, a misalignment problem probably occurred and the sheet is ejected at 338.)

Once cutting is finished, the cutter nips are activated at 338 to eject the cut sheet. This action by the cutter nips can be effected, for example, by programming the cutter controller to utilize the cutter nip to feed the cut media to the out-feed receptacle. After ejection, the cutter nip can be turned off at 340. A determination is made at 342 as to whether there are more sheets in the job. If so, the process returns to 316. If not, the job ends at 344.

In one variation of the process shown in FIG. 6, the positioning of the sheet in the cutter may occur without requiring backward movement. In this case, movement of the sheet usually is stopped by stopping rotation of the cutter nip at 326. In another variation, a different type of feed mechanism is used in the process, for example, vacuum feed technology, especially for feeding the sheets of media into the cutter, and optionally also for moving the sheets within and out of the cutter.

For partially manual operation of the system, as is shown in FIG. 7 and as designated as 400, an operator selects the cutting program and optionally selects the number of documents to be cut at 411 (unless, for example, the number of media sheets in the in-feed receptacle equals the number of sheets to the cut). The job is started at 412 by pressing a "start button" or in another manner. The feeder is turned on (often a nudger roll and a retard feed assembly) at 414, resulting in the automatic feeding of a first sheet of media at 416. The take-away rolls (if included) are either turned on with the retard feed system or are activated when the presence of media is sensed. The media is automatically fed, one sheet at a time, using the nips of the retard feeder and take-away rolls. The sheet of media moves forward in the system until its leading edge is sensed with a first sensor at 418. The sheet of media continues to advance until it has passed the cutter nip and its leading edge is sensed with a second sensor inside the cutter at 420. After sensing by the second sensor, the travel direction of the sheets often is reversed at 422. If the second sensor does not sense the sheet, a feed error is assumed to have occurred and the sheet feed error is corrected at 424. The process re-starts with a return to 412, 414 or 416.

After the travel direction of the sheet is reversed at 422, the sheet travels in the reverse direction until it is properly aligned, according to sheet edge detection via the second sensor. At this point, the cutter nip stops at 426. The appropriate sheet registration algorithm is activated at 430 based on the cutting program that was selected at 411. After the registration marks are found at 432, the media is digitally cut at 434. (If there is a problem finding the registration marks, a misalignment problem probably occurred and the sheet is ejected at 438.)

Once cutting is finished, the cutter nips are activated at 438 to eject the cut sheet. After ejection, the cutter nip can be turned off at 440. A determination is made at 442 as to whether there are more sheets in the job. If so, the process returns to 416. If not, the job ends at 444.

Figure 8:
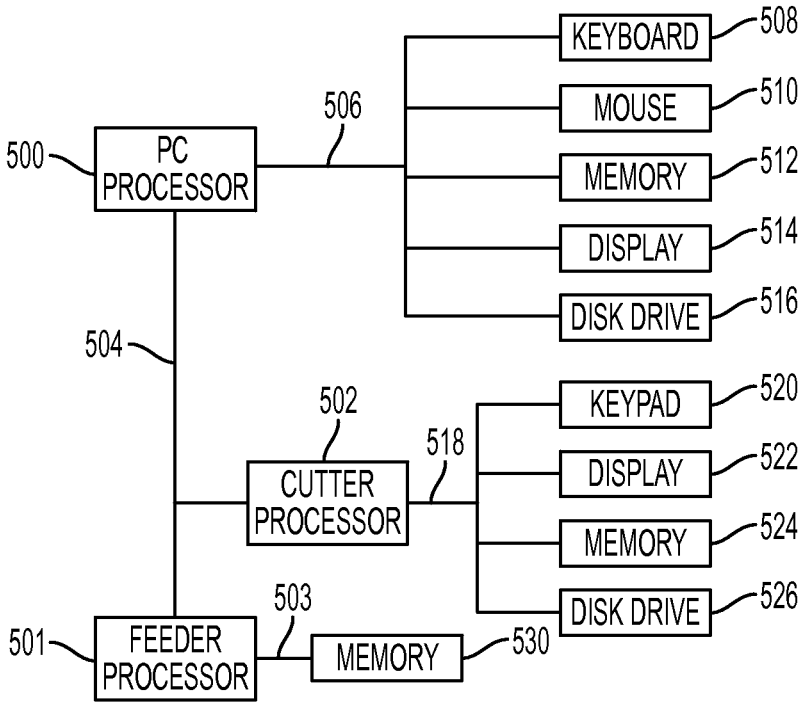
FIG. 8 is a block diagram of an exemplary system that can be used to contain or implement program instructions for the embodiment of FIG. 2.
Figure 9:
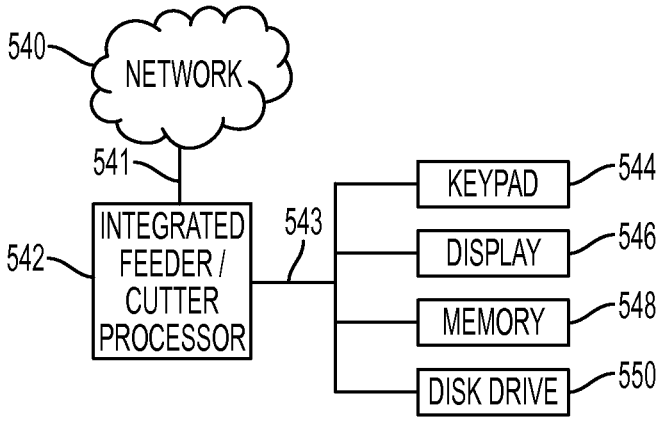
FIG. 9 is a block diagram of an exemplary system that can be used to contain or implement program instructions for the embodiment of FIG. 3.

In one variation of the process shown in FIG. 7, the positioning of the sheet in the cutter may occur without requiring backward movement. In this case, movement of the sheet usually is stopped by stopping rotation of the cutter nip at 326. In another variation, a different type of feed mechanism is used in the process, for example, vacuum feed technology, especially for feeding the sheets of media into the cutter, and optionally also for moving the sheets within and out of the cutter FIGS. 8-9 depict non-limiting examples of computer systems that can be used to implement program instructions for use with the feeding and cutting systems shown in FIGS. 2-3. In FIG. 8, which corresponds to certain embodiments of the system of FIG. 2, a PC processor 500, a cutter processor 502, and a feeder processor 501 are interconnected by a bus or other data transfer subsystem 504. A bus or other data transfer subsystem 506 interconnects the PC processor 500 with the other system components, including a keyboard 508, which may be in the form of a physical keyboard and/or a touch screen, a mouse 510, a memory 512, a display 514 and one or more disk drives 516 of various types. A bus or other data transfer subsystem 518 interconnects the cutter processor 502 with the other system components, including a keypad 520, which may be in the form of a physical keypad and/or a touch screen, a display 522, a memory 524 and one or more disk drives 526 of various types. A bus or other data transfer subsystem 503 interconnects the feeder processor 501 with memory 530. Media can be removed from the cutter using the cutter processor 502 or the feeder processor 501. In FIG. 9, which corresponds to the system of FIG. 3, a processor for integrated feeding and cutting 542 is interconnected by a bus or other data transfer subsystem 543 to the other system components, including a keypad 544, which may be in the form of a physical keypad and/or a touch screen, a display 546, a memory 548 and one or more disk drives 550 of various types. The processor 542 is also connected to a network 540 via a data bus 541. The electronic connections shown in the figures can be hardwired or wireless depending on the technology selected and available for use.

Non-limiting examples of digital cutters that can be combined or integrated with the media loading system include the Graphtec Craft Robo Pro, Roland Desktop, Cricut, Maki and Ioline. A non-limiting example of feed technology that can be adapted for use with this system is Xerox® retard feed technology, which can be incorporated into an adapted version of a by-pass feeder used in a multifunction printing device.

The embodiments shown in FIGS. 1-11 are particularly well-suited to cut in the range of 5-60 sheets of media per hour, or 10-45 sheets per hour, or 15-30 sheets per hour depending on the complexity of the cutting performed.

Typical systems occupy a floor footprint in the range of 8-25 square feet, or 10-18 square feet, or 10-15 square feet, enabling the system to be used in small print shops. The volume occupied by the system typically is in the range of 20-100 cubic feet, or 20-60 cubic feet, or 20-40 cubic feet.

As indicated above, the system enables a print shop to produce low cost dimensional documents for low volume print jobs in an economically competitive manner. The system and method are particularly well suited for use in low volume and short run packaging applications ranging from 2 to 500 pieces. Print jobs in the range of 1-500, or 1-250 or 1-100 are well suited for cutting using the system and method described.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims. Unless specifically defined in a specific claim itself, steps or components of the invention should not be implied or imported from any above example as limitations to any particular order, number, position, size, shape, angle, color, or material.

What is claimed is:

1. A media feeding and cutting system comprising:

a media cutter including a cutting surface and a digital cutting device, a media in-feed receptacle configured to support a stack of sheets of media, a first feeder disposed adjacent to or connected to the cutting surface, the first feeder comprising a first feed device configured to automatically transport individual sheets of media from the in-feed receptacle toward the cutter, a positioner configured to position an individual sheet of media on the cutting surface, the positioner comprising a second feed device including a first feed nip disposed in the cutter, an out-feed receptacle configured to receive cut sheets of media, a second feeder disposed adjacent to or connected to the cutting surface, the second feeder being configured to automatically transport the cut sheet of media from the cutter to the out-feed receptacle, and a processor configured to operate the cutter, first feeder, positioner and second feeder.

2. The media feeding and cutting system of claim 1, wherein the positioner includes a first sensor that senses a first edge of a sheet of media.

3. The media feeding and cutting system of claim 1, wherein the first feed device comprises a second feed nip.

4. The media feeding and cutting system of claim 1, wherein the first feed device is a retard feed nip.

5. The media feeding and cutting system of claim 4, wherein the retard feed nip includes a drive roll and a retard roll.

6. The media feeding and cutting system of claim 1, wherein the first feed nip is configured to move a sheet of media forward and backward in the cutter.

7. The media feeding and cutting system of claim 1, wherein the second feed device operates as both a part of the positioner and as the second feeder.

8. The media feeding and cutting system of claim 4, wherein the first feeder includes a third feed device disposed between the first feed device and the second feed device, the third feed device advancing the media forward from the retard feed nip to the cutting surface.

9. The media feeding and cutting system of claim 1, wherein the processor includes a first processor configured to operate the first feeder, and a second processor configured to operate the positioner, the cutter and the second feeder.

10. The media feeding and cutting system of claim 1, wherein the processor is a single processor configured to operate the first feeder, positioner, cutter and second feeder.

11. The media feeding and cutting system of claim 1, wherein the media sheets are pre-printed.

12. The media feeding and cutting system of claim 1, further including first and second baffles positioned between the first feed device and the cutting surface to direct the movement of the individual sheets of media into the cutter.

13. The media feeding and cutting system of claim 12, further including a third baffle positioned upstream from the cutting surface to direct the backward movement of the individual sheets of media when the sheets are being positioned in the cutter.

14. The media feeding and cutting system of claim 12, further including a fourth baffle to direct the movement of the individual sheets of media onto the cutting surface.

15. The media feeding and cutting system of claim 1, further including a sensor configured to read data on sheets of media.

16. The media feeding and cutting system of claim 15, wherein the data comprises an information code.

17. A media feeding system comprising:

a media in-feed receptacle, a digital cutter, a first feeder configured to be retrofitted to a first side of the digital cutter, the first feeder including a first feed device configured to automatically transport individual sheets of media in a forward feed direction from the media in-feed receptacle to the digital cutter, a media out-feed receptacle, a second feeder configured to automatically transport individual sheets of media from the digital cutter to the media out-feed receptacle, and a processor configured to operate the first feeder, the second feeder and the digital cutter, the processor including a feeder processor configured to operate the first feeder, the feeder processor being connected by a data transfer subsystem to a cutter processor configured to operate the cutter.

18. The media feeding system of claim 17, wherein the first feed device comprises a first feed nip that includes a drive roll and a retard roll.

19. A method of feeding media to and from a cutting surface of a digital cutter, comprising:

acquiring a sheet of media from an in-feed receptacle configured to hold a stack of individual sheets using an automatic first feeder that includes a first feed device, automatically moving the sheet of media in a forward feed direction between first and second baffles to the cutting surface using the first feeder, automatically placing the sheet of media on the cutting surface, moving the sheet of media in a backward feed direction using a second feed device in order to position the sheet of media on the cutting surface at a desired location, cutting the sheet of media, automatically feeding the cut sheet of media out of the cutter, and releasing the sheet of media into an out-feed receptacle.

20. The method of claim 19, further comprising automatically moving the sheet of media out of the first feed device using a third feed device disposed between the first feed device and the second feed device.

21. The media feeding and cutting system of claim 8, wherein the second feed device is configured to move a sheet of media forward and backward in the cutter, and the processor includes a first processor configured to operate the first feeder, and a second processor configured to operate the positioner, the cutter and the second feeder.

22. The media feeding and cutting system of claim 17, wherein the cutter processor is configured to operate the second feeder.

23. The media feeding and cutting system of claim 17, wherein the feeder processor is configured to operate the second feeder.

24. The method of claim 20, wherein the second feed device includes a feed nip.

* * * * *